United States Patent [19]

Takahashi et al.

[11] 4,196,050

[45] Apr. 1, 1980

[54] DECOKING APPARATUS

[75] Inventors: Hisao Takahashi, Yokohama; Takeshi Nomura; Yoshitomo Ohara, both of Tokyo; Hajime Nakanishi, Fujisawa; Naotaka Miwa, Ichihara; Naoshi Kawabe, Ichihara; Tomizo Endo, Ichihara; Hiroshi Hozuma, Ichihara; Minoru Akimoto, Iwaki, all of Japan

[73] Assignees: Kureha Kagaku Kogyo Kabushiki Kaisha, Tokyo; Chiyoda Chemical Engineering & Construction Co., Ltd., Yokahama, both of Japan

[21] Appl. No.: 874,947

[22] Filed: Feb. 3, 1978

[30] Foreign Application Priority Data

Feb. 4, 1977 [JP] Japan ..... 52-11556[U]

[51] Int. Cl.[2] ..... C10G 7/00; C10G 9/12

[52] U.S. Cl. ..... 196/122; 134/22 R; 134/167 R; 201/2; 196/126; 196/127; 196/128; 422/187; 422/207; 208/48 Q

[58] Field of Search ..... 196/122, 126–128; 201/2; 208/48 R, 48 Q; 134/22, 24, 39, 167, 168; 239/227

[56] References Cited

U.S. PATENT DOCUMENTS

| | | | |
|---|---|---|---|
| 1,912,629 | 6/1933 | Fisher | 208/48 R X |
| 2,326,525 | 8/1943 | Diwoky | 196/122 X |
| 3,522,016 | 7/1970 | Groves et al. | 134/39 X |
| 3,836,434 | 9/1974 | Novy | 134/39 X |
| 3,953,226 | 4/1976 | Emond et al. | 134/168 R X |
| 3,985,572 | 10/1976 | Petermann | 134/22 R X |

*Primary Examiner*—Michael S. Marcus

*Attorney, Agent, or Firm*—Stevens, Davis, Miller & Mosher

[57] ABSTRACT

A decoking device suitable for use on a reaction vessel for the thermal cracking of heavy petroleum oils, including an assembly mounted on top of the reaction vessel and having a cylinder and a piston slidably and rotatably received in the cylinder, the cylinder and piston defining a scrubbing liquid chamber which is sealed from the outside. A scrubbing liquid is fed through the scrubbing liquid chamber to a main injection pipe to inject the liquid through a multitude of jet nozzles in the main injection pipe against the inner wall surfaces of the reaction vessel, the main injection pipe being connected to the piston for movement therewith.

7 Claims, 1 Drawing Figure

DECOKING APPARATUS

BACKGROUND OF THE INVENTION

1. Field of the Invention

This invention relates to a decoking apparatus, and more particularly to a decoking apparatus useful for removing coke deposited on the inner wall surfaces of a reaction vessel for the thermal cracking of heavy petroleum oils.

In the case of producing pitches, heavy petroleum oils (hereinafter referred to as heavy oils) such as asphalt and coaltar are usually thermally cracked in a reaction vessel. In this connection, it is the general practice to admit a hot gas, which does not react with the heavy oils, in the temperature range of 400° to 2000° C. into the reaction vessel through its bottom to induce thermal cracking of the charged material. During the cracking operation, the charged material undergoes intense bubbling and spatters around onto the inner wall surfaces of the reaction vessel, forming deposits of coke thereon. The coke deposit grows into a substantial thickness while the reaction vessel is used for several batches and partially comes off the reactor wall, causing various problems in the subsequent operations, for example, clogging of the nozzle through which the reacted product is drawn out.

2. Description of Prior Art

The countermeasure which has been conventionally resorted to in this regard is to remove the deposited coke by high-pressure water jets or by mechanical scraping after the reaction vessel has been used for several batches or when the coke deposit has grown to certain extent. However, these conventional methods invariably necessitate cooling to room temperature the reaction vessel which has been maintained at about 400° C., requiring suspension of the cracking operation for a long period of time and compelling the operator to do the coke removing work in undesirable environment.

In view of the difficulties encountered in the coke removing operation, we have already developed a new concept of injecting part of charging raw material through a rotary injection pipe toward the inner wall surfaces of the reactor to remove the deposited coke therefrom. This prior invention succeeded in eliminating the above-mentioned difficulties of the conventional methods. The present invention contemplates to provide an apparatus which can effectively carry out the decoking method developed by us.

Since the interior of the reaction vessel is exposed to high temperature and high pressure during the cracking operation, the drive mechanism for rotating the injection pipe is normally provided on the outer side of the reaction vessel. As a result, the injection pipe is necessarily connected to a fixed feed pipe also outside the reaction vessel and it becomes necessary to provide a secure seal at the joint between the rotary injection pipe and the fixed feed pipe in addition to the joint between the injection pipe and the reaction vessel. This is important particularly where very inflammable material such as hot asphalt or toxic material is handled.

SUMMARY OF THE INVENTION

The present invention has as its object the provision of a decoking apparatus which precludes leakage of fluid from the reaction vessel while retaining the advantages of the rotary injection system. This and other objects, features and advantages of the invention will become apparent from the following description.

According to the present invention, there is provided a cylinder assembly mounted on top of the reaction vessel having a cylinder and a piston slidably and rotatably received in the cylinder, the cylinder and piston defining a scrubbing liquid chamber, and a main injection pipe disposed in the reaction vessel and having a multitude of jet nozzles for injection of a scrubbing liquid from the scrubbing liquid chamber against inner wall surfaces of the reaction vessel, the main injection pipe being connected to the piston for movement therewith.

The apparatus according to the present invention also has the drive assembly for rotating the main injection pipe provided outside the reaction vessel but the injection pipe communicates with a fixed feed pipe through a scrubbing liquid chamber in the cylinder assembly which is mounted integrally on the reaction vessel, so that there is less possibility of leakage at the joint as compared with conventional external joints.

In one preferred form of the invention, the cylinder assembly is provided with sealing fluid chambers above and below the afore-mentioned scrubbing liquid chamber. A sealing fluid inert to the heavy oil cracking reactions, for example, steam or nitrogen gas is admitted into the sealing fluid chambers to seal the scrubbing liquid chamber which functions as a joint between the rotary injection pipe and the fixed feed pipe, completely precluding leakage of heavy oil to the outside from the scrubbing liquid chamber. As mentioned before, the joint is provided within the cylinder assembly, so that there is almost no possibility of the leakage of the scrubbing liquid. However, the scrubbing liquid is fed under high pressure and tends to leak through fine clearances between the cylinder and piston rings and through the seals of the rotating shaft of the main injection pipe. This tendency is increased all the more when the main injection pipe is moved up and down simultaneously with its rotation. The sealing fluid chambers mentioned above effectively prevent the scrubbing liquid leakages of this sort.

In another preferred form of the invention, the main injection pipe is rotatable about the vertical axis of the reaction vessel and at the same time movable up and down within the reaction vessel, and a second scrubbing liquid chamber is provided on the upper side of the scrubbing liquid chamber for the main injection pipe, the second scrubbing liquid chamber feeding the scrubbing liquid to an auxiliary injection pipe for injection of the liquid over the outer peripheral wall surfaces of the main injection pipe to keep those surfaces in a wet state. The vertical movement of the main injection pipe ensures that the jets of scrubbing liquid cover the entire inner wall surfaces of the reaction vessel to remove deposited coke clearly therefrom. In addition, the provision of the second scrubbing liquid chamber over the first scrubbing liquid chamber all the more increases the effect of sealing the high-pressure liquid in the latter chamber by the low-pressure liquid in the former chamber.

DETAILED DESCRIPTION OF THE INVENTION

Figure 1:
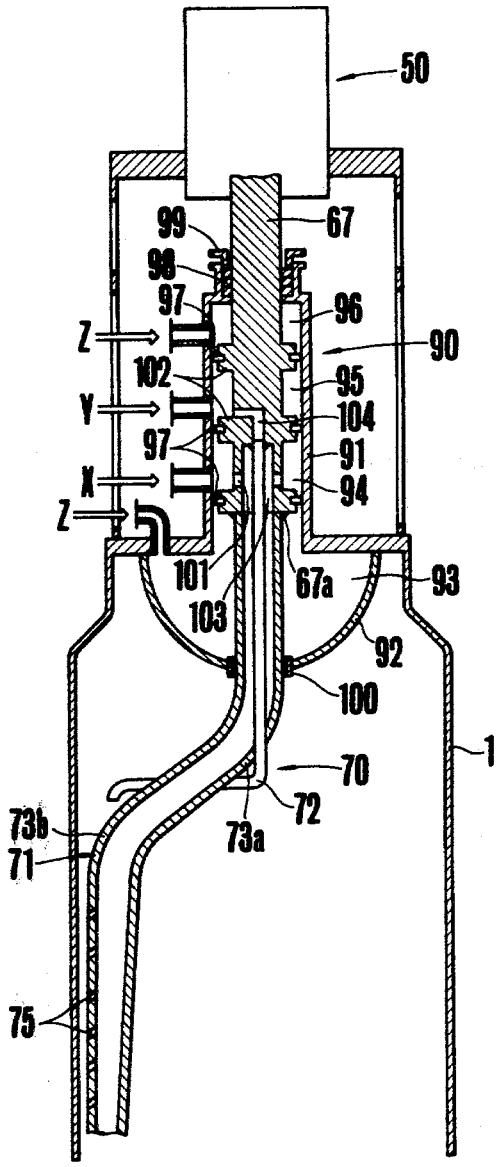
FIG. 1 is a schematic sectional view showing essential portions of the decoking apparatus according to the invention, wherein the drive assembly is indicated simply by a block.

Referring to FIG. 1, the decoking apparatus according to the present invention includes a drive assembly 50 which is mounted over the reaction vessel 1 for the rotating and vertically moving operations. The drive shaft (not shown) of the drive assembly 50 is connected through a piston rod 67 to the upper end of an injection pipe assembly 70 which is disposed within the reaction vessel 1. A cylinder assembly 90 is mounted on top of the reaction vessel 1 to feed decoking heavy oil to the injection pipe assembly while hermetically sealing the upper end of the reaction vessel 1.

The drive assembly 50, which mechanism is well-known per se, includes an electric motor and a reduction gear for rotating and moving up and down the injection pipe assembly 70 through the drive shaft. The drive assembly 50 is provided with a control circuit for sequentially controlling the rotational and up-down movements of the injection pipe assembly 70.

Furthermore, the drive assembly is so constructed that both radial and thrust loads imparted to it are born within itself to make it compact.

The injection pipe assembly 70 disposed within the reaction vessel 1 consists of a main injection pipe 71 and an auxiliary injection pipe 72 which is adapted to pour a scrubbing liquid constantly over the outer peripheral wall surfaces of the main injection pipe 71 to keep those surfaces in a wet state. The main injection pipe 71 is provided with a multitude of vertically aligned jet nozzles 75 in its wall on the side facing the inner wall surface of the reaction vessel 1 to inject therethrough high-pressure jets of scrubbing heavy oil. The respective jet nozzles 75 are inclined downwardly outwardly at an angle of 45° with respect to the axis of the main injection pipe 71. The number, arrangement and shape of the jet nozzles 71 should be determined suitably in relation to the amount and pressure of the heavy oil to be injected. The main injection pipe 71 is closed at its lower end and has two bent portions 73*a* and 73*b* so that the straight lower end portion is in a closely opposing relationship with the inner wall surfaces of the reaction vessel 1. The auxiliary injection pipe 72 extends through the center of the main injection pipe 71 as far as the bent portion 73*a* where the auxiliary pipe 72 goes through the wall of the main pipe 71. The lower end portion of the auxiliary injection pipe 72 which projects out of the main injection pipe 71 extends to and opens over the bent portion 73*b* where the main injection pipe 71 bends to extend closely along the inner wall surface of the reaction vessel 1. The open distal end of the auxiliary injection pipe 72 is located and disposed so that the heavy oil which it discharges flows uniformly over the outer wall surfaces of the main nozzle pipe 72. In this embodiment, the heavy oil to be poured on the outer surface of the main injection pipe 71 may be emitted by gravity or may be injected under pressure if desired. The free end 74 of the auxiliary injection pipe 72 may be helically wound around the circumference of the main injection pipe 71. If arranged in this manner, the open end of the auxiliary injection pipe is maintained in a constant position relative to the main injection pipe 71, adapting itself to the contraction or elongation of the main injection pipe 72 due to thermal stress.

The main injection pipe 70 within the reaction vessel 1 has to be formed from a light material since it is exposed to high temperatures, shaken by the bubbling, stressed repeatedly by the reactions of the jets during the decoking operation, and influenced by the moments resulting from eccentric deviations of the main and auxiliary injection pipes 71 and 72. For example, the injection pipe portion 70 may be constituted by a single carbon steel pipe which is inserted in the reaction vessel. It is conceivable to provide a main injection pipe which is bifurcated or trifurcated at the lower end of its upper straight portion and to provide an auxiliary injection pipe at the bent portion of each one of the bifurcated or trifurcated pipe portions, but this is not desirable in view of the above-mentioned stress factors.

The main and auxiliary injection pipes 71 and 72 and the piston 67 are assembled by the following procedure. The piston 67 is provided with an axial bore 103 in its lower end face. The bore 103 has the same diameter as the inside diameter of the main injection pipe 71 and communicates through a bottom passage 104 with a scrubbing liquid chamber 95 which will be described later. A straight pipe to be formed into the auxiliary injection pipe 72 is inserted into a through hole which is provided on the lower side of the bent portion of the main injection pipe 71, and the upper end of the auxiliary injection pipe is then fitted into the bottom passage 104, welding the outer periphery of the auxiliary injection pipe 72 to the bottom of the bore 103. Thereafter, the upper end of the main injection pipe 71 is abutted against and welded to the lower end 67*a* of the piston 67. Finally, the auxiliary injection pipe 72 is welded to the main injection pipe 71, around its outer periphery where it projects out of the bent portion of the main pipe, and the projecting lower end of the auxiliary injection pipe is bent in the above-described manner.

The cylinder assembly 90 is mounted on top of the reaction vessel 1 to feed high pressure heavy oil and low pressure heavy oil to the main and auxiliary injection pipes 71 and 72, respectively, while sealing the upper end of the reaction vessel 1 to prevent leakage of inflammable gases and other material including heated asphalt. The cylinder assembly 90 has a cylinder 91 which is mounted on the upper end of the reaction vessel 1 and which has a bottom wall 92 extending from the underside of its base into the interior of the reaction vessel 1 to define a lower steam chamber 93 around the main injection pipe 72. The cylinder 91 further defines, in cooperation with the lands on the piston 67, a high-pressure heavy oil chamber 94, a low-pressure heavy oil chamber 95, and an upper steam chamber 96. These chambers are sealed by piston rings 97 on the respective lands. The upper steam chamber 96 is sealed from the atmosphere by packing 98 and packing gland 99. The bottom wall 92 of the lower steam chamber 93 is provided with a cylindrical anti-vibratory member 100 which prevents the vibration of the main injection pipe 71.

The anti-vibratory member 100 serves to suppress the shuddering vibrations which are necessarily imparted to the main injection pipe 71 by the reactions of the high-pressure jets of scrubbing liquid injected by the main injection pipe, for example, at 20 kg/cm$^2$, and by the vigorous bubbling of high-pressure vapors which form during the cracking operation.

The high-pressure heavy oil chamber 94 of the cylinder 91 communicates with the main injection pipe 71 through an opening 101 and receives a supply of high-pressure heavy oil from the direction X for injection through the jet nozzles 75 of the main injection pipe 71 against the inner wall surfaces of the reaction vessel 1.

The low-pressure heavy oil chamber 95 communicates with the auxiliary injection pipe 72 and receives a supply of low-pressure heavy oil from the direction Y for injection from the lower end of the auxiliary injection pipe 72 onto the outer peripheral walls of the main injection pipe 71. The lower and upper steam chambers 93 and 96 respectively receive a supply of steam from the direction Z to ensure freedom of rotational and up-down movement of the injection pipe assembly 70 while completely sealing the gases and heavy oil within the reaction vessel 1 and the high-pressure and low-pressure heavy oil in the chambers 94 and 95 in cooperation with the piston 102, piston ring 97 and packing 98. The heavy oil can be charged while the injection pipe assembly is in the rotational or up-down shift operation.

In operation, steam is constantly fed to the respective steam chambers from the direction Z. During the batchwise cracking operation, low-pressure heavy oil is fed to the auxiliary injection pipe 72 to keep the outer peripheral walls of the main injection pipe 71 in a wet state. Upon completion of one batch operation, high-pressure heavy oil is fed from the direction X into the main injection pipe 71 which is now put in rotation to inject the heavy oil against and around the inner wall surfaces of the reaction vessel 1. Arrangement is made such that the main injection pipe is lifted as soon as it completes one round of decoking operation. The lifting of the main injection pipe 71 shifts the positions of the outwardly downwardly inclined jet nozzles 75 relative to the inner wall surfaces of the reaction vessel 1. In this connection, it is preferred to lift the main injection pipe 71 by a distance corresponding to the intervals between the individual jet nozzles 75 to ensure complete removal of the deposited coke. In this particular embodiment, the drive shaft has a full stroke length of 100 mm while the jet nozzles 75 are spaced from adjacent ones by a distance of about or shorter than 100 mm. This will be satisfactory for normal operations. The drive shaft is each time lifted by a distance corresponding to $\frac{1}{3}$ of its full stroke length, for instance, by controlling the rotation of the drive shaft with use of a tachometer. The rotation and up-down shifting of the main injection pipe 71 are effected separately in normal operations but both may be effected simultaneously.

Instead of shifting the injection pipe assembly by the drive assembly 50, it is possible to operate the piston cylinder by fluid pressure, for example, by moving the piston 67 up and down by controlling the pressure of steam admitted into the upper and lower steam chambers 96 and 93.

According to the present invention, the scrubbing liquid is fed to the injection pipe assembly which is disposed within the reaction vessel, through a completely sealed chamber within a cylinder assembly which is mounted on the reaction vessel, so that it becomes possible to remove the deposited coke completely and to use the reaction vessel for continuous or repeated cracking operations. Since the reaction vessel and joints are securely sealed from the outside, the leakage of the reaction gases and inflammable hot asphalt and the like is precluded and the hot asphalt or other raw material can be charged even during the up-down shifting operation of the injection pipe.

In addition, the seals are simple in construction as compared with the conventional counterparts, easily maintained and low in cost.

What is claimed is:

1. An apparatus for decoking a reaction vessel adapted for the thermal cracking of heavy petroleum oil comprising:

cylinder assembly means adapted for mounting in a top opening of a reaction vessel, said cylinder assembly means including cylinder means and piston means mounted in said cylinder means for reciprocating movement, said cylinder means and piston means defining a fluid chamber divided into multiple subchambers including a main scrubbing liquid subchamber and sealing fluid subchambers;

a main injection pipe in communication with said main scrubbing liquid subchamber and being connected to said piston means for reciprocating motion therewith; said main injection pipe having a plurality of perforations along the lower length of said main injection pipe for injecting scrubbing liquid from said main scrubbing liquid subchamber against inner wall surfaces of a reaction vessel;

means for injecting a fluid into said sealing subchambers of said multiple subchambers to drive said piston means with reciprocating motion; and means for rotating said main injection pipe.

2. A decoking apparatus as defined in claim 1 wherein one of said sealing subchambers is provided on the lower side of said main scrubbing liquid subchamber.

3. The apparatus of claim 1 wherein one of said sealing subchambers is a sealing fluid chamber which is beneath said main scrubbing liquid subchamber and has a bottom wall portion with cylindrical means for receiving and preventing vibration of said main injection pipe.

4. The apparatus of claim 1 wherein said multiple subchambers are formed within said fluid chamber by land means on said piston means.

5. A decoking apparatus as defined in claim 1, further comprising an auxiliary injection pipe for scrubbing the outer peripheral wall of said main injection pipe, said auxiliary injection pipe communicating with an auxiliary scrubbing subchamber of said multiple subchambers.

6. The apparatus of claim 5 wherein one of said sealing subchambers is provided on the lower side of said main scrubbing liquid subchamber.

7. The apparatus of claim 5 wherein said auxiliary pipe is mounted on said main injection pipe for movement therewith.

* * * * *